US008246324B2

(12) United States Patent
Chou

(10) Patent No.: US 8,246,324 B2
(45) Date of Patent: Aug. 21, 2012

(54) PIEZOELECTRIC FAN ASSEMBLY

(75) Inventor: Ming-Der Chou, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 500 days.

(21) Appl. No.: 12/482,397

(22) Filed: Jun. 10, 2009

(65) Prior Publication Data

US 2010/0284839 A1 Nov. 11, 2010

(30) Foreign Application Priority Data

May 7, 2009 (CN) ..... 2009 1 0302155

(51) Int. Cl.
*H05K 7/20* (2006.01)

(52) U.S. Cl. ..... 417/410.2; 361/695

(58) Field of Classification Search ..... 417/410.1, 417/410.2; 361/695
See application file for complete search history.

(56) References Cited

U.S. PATENT DOCUMENTS 7,742,299 B2 * 6/2010 Sauciuc et al. ..... 361/695
2008/0137289 A1 * 6/2008 Arik et al. ..... 361/689

* cited by examiner

*Primary Examiner* — Charles Freay
*Assistant Examiner* — Patrick Hamo
(74) *Attorney, Agent, or Firm* — Altis Law Group, Inc.

(57) ABSTRACT

A piezoelectric fan assembly includes a case defining an air outlet, a fan arranged in the case, and a guide plate mounted in the case and encircling the fan. The fan includes a mandrel positioned in the case, two swing members mounted to the mandrel and each including a piezoelectric element, a circular connecting portion connected to the at least one swing member, and a number of fan blades mounted to the connecting portion to generate airflow by the swing members in response to the piezoelectric element receiving alternating current power. A wind channel is formed between the case and the guide plate. A number of openings are defined in the guide plate corresponding to the fan blades. The guide plate is to transfer airflow from the number of fan blades to the air outlet via the wind channel, through the number of openings.

13 Claims, 9 Drawing Sheets

PIEZOELECTRIC FAN ASSEMBLY

BACKGROUND

1. Technical Field

The present disclosure relates to a piezoelectric fan assembly.

2. Description of Related Art

Piezoelectric fans have been used in harsh environments with wide temperature ranges, wide humidity ranges, or even in hazardous and explosive gas conditions. However, an ordinary piezoelectric fan generally includes one or two fan blades, thereby only a little airflow is generated and the airflow is not very concentrated, and therefore heat is not dissipated efficiently.

DETAILED DESCRIPTION

Figure 1:
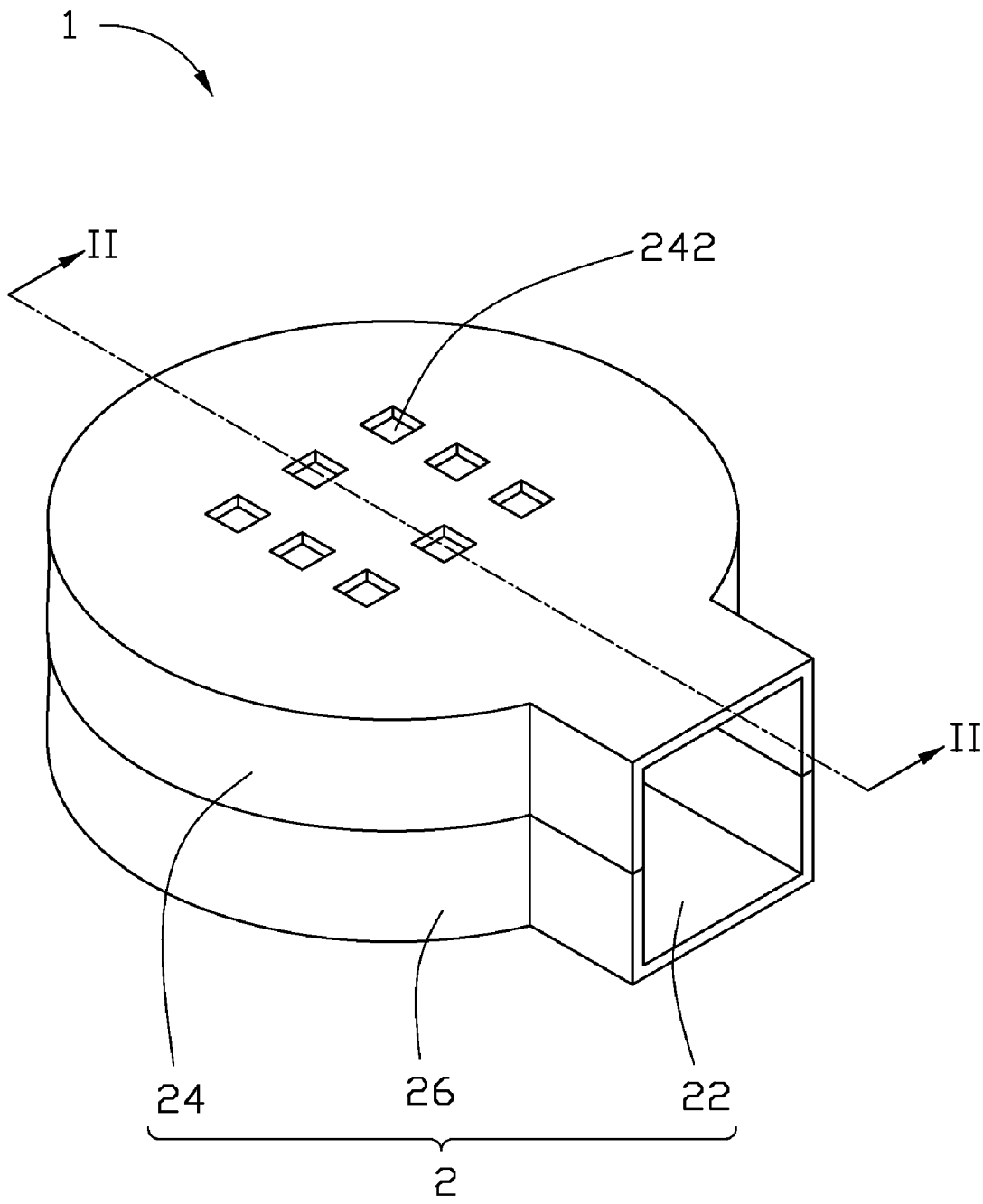
FIG. 1 is an isometric, schematic view of an exemplary embodiment of a piezoelectric fan assembly.
Figure 2:
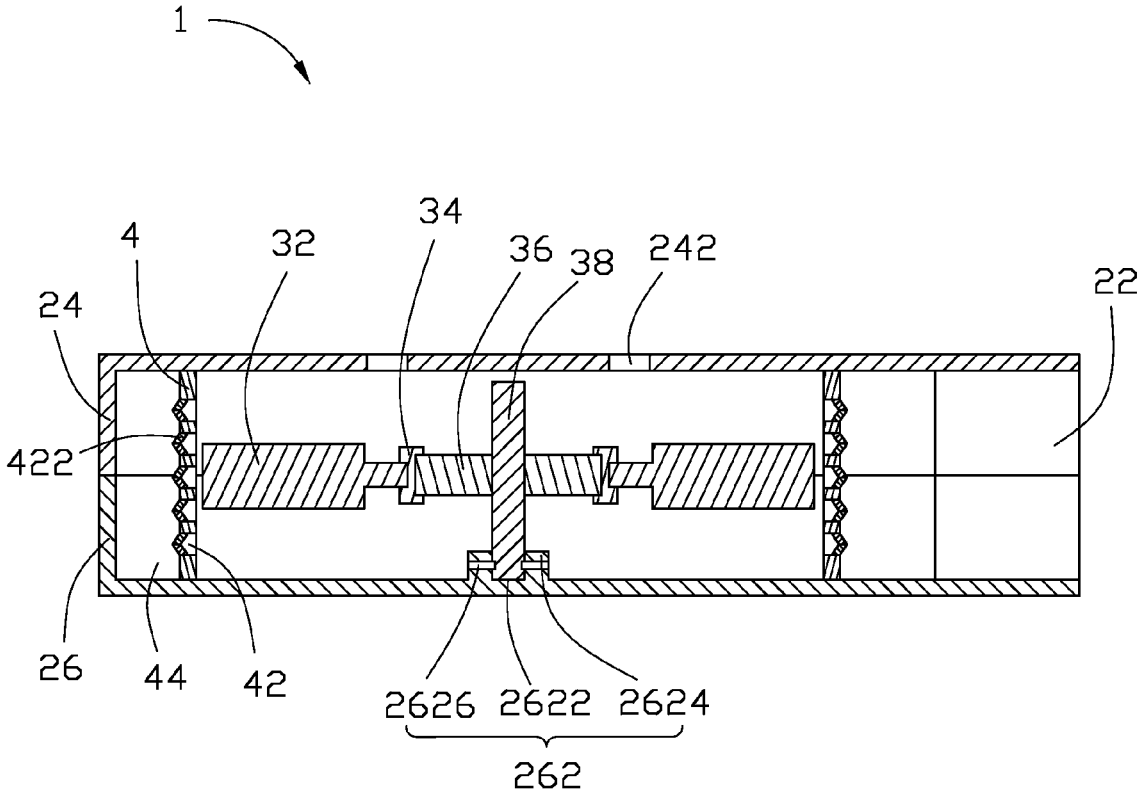
FIG. 2 is a cross-sectional view of the piezoelectric fan assembly of FIG. 1, taken along the line II-II, the piezoelectric fan assembly including an upper cover, a lower cover, a mandrel, two swing members, and a guide plate.
Figure 3:
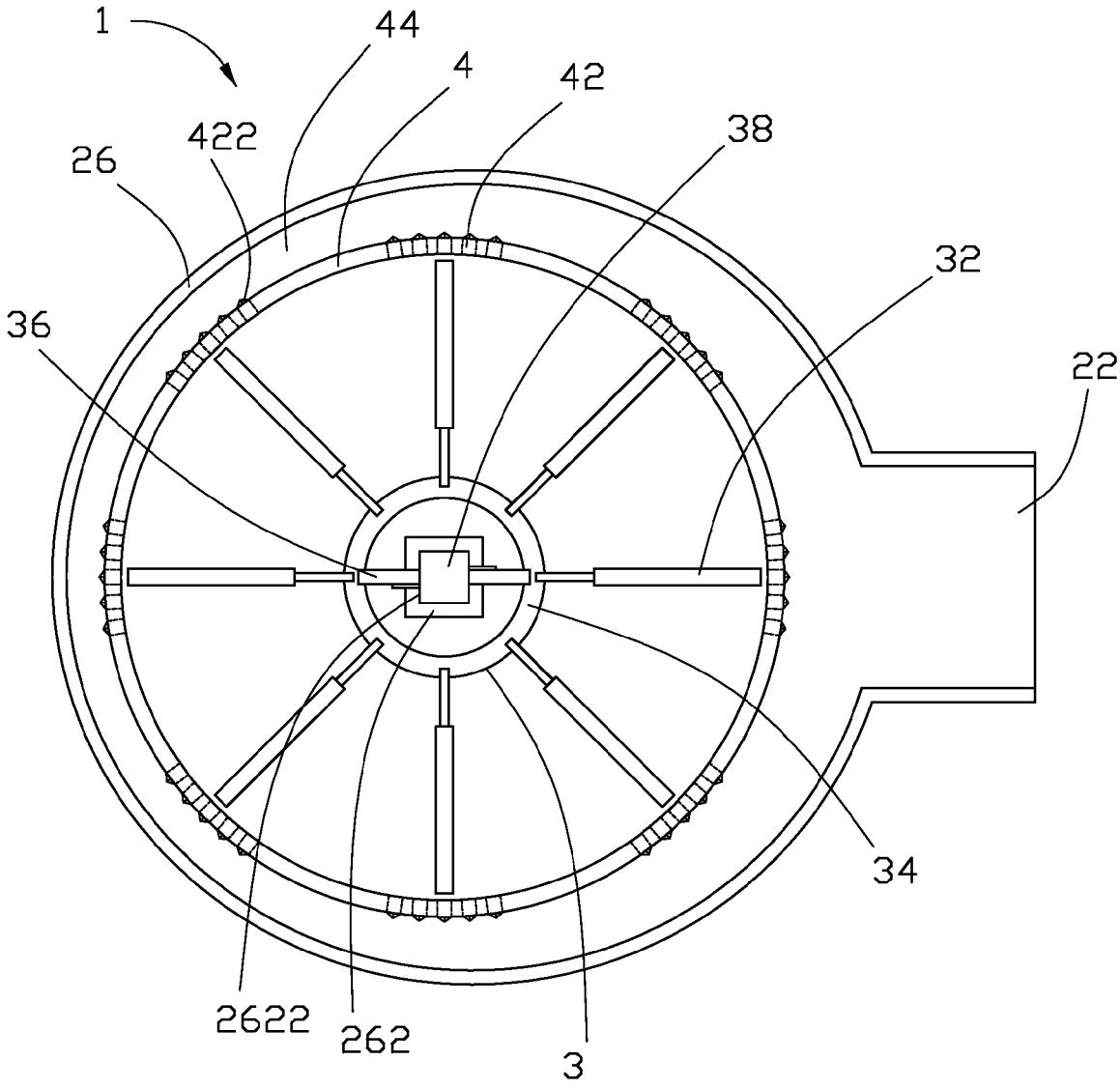
FIG. 3 is a top plan view of the piezoelectric fan assembly of FIG. 1, without the upper cover.

Referring to FIGS. 1 to 3, an exemplary embodiment of a piezoelectric fan assembly 1 includes a case 2, a fan 3 arranged in the case 2, and a guide plate 4 arranged in the case 2.

The case 2 includes a lower cover 26 and an upper cover 24 covered on the lower cover 26. The upper cover 24 and the lower cover 26 are approximately round-shape and connected together via latching structures (not shown), and form a rectangular air outlet 22 at a circumference of the case 2. The upper cover 24 defines a plurality of air inlets 242 therein to receive outside air. In other embodiments, the plurality of air inlets 242 can be defined in the lower cover 26.

A mounting portion 262 is formed at a position off a center of the lower cover 26, in the case 2. The mounting portion 262 defines a positioning hole 2622 in a center thereof. Each of two opposite sides 2624 of the mounting portion 262 defines a screw hole 2626 therein. In other embodiments, the mounting portion 262 can be formed at a position off a center of the upper cover 24.

The fan 3 includes a plurality of fan blades 32, a circular connecting portion 34 located above the mounting portion 262 of the lower cover 26, two swing members 36, and a mandrel 38. The connecting portion 34 is made of insulating lightweight material, such as polycarbonate (PC) material. The fan blades 32 are made of polyester material, plastic material, steel material, or other metal material. A first end of the mandrel 38 is inserted into the positioning hole 2622 of the mounting portion 262, and two screws are screwed into the screw holes 2626 of the mounting portion 262 to position the mandrel 38 on the lower cover 26. Therefore, the mandrel 38 extends up from the lower cover 26 towards the upper cover 24, along an axis of the connecting portion 34. The connecting portion 34 is connected to the mandrel 38 via the two swing members 36. An end of each of the plurality of fan blades 32 is fixed to the connecting portion 34, therefore, the fan blades 32 radially extend out from the connecting portion 34.

Figure 4:
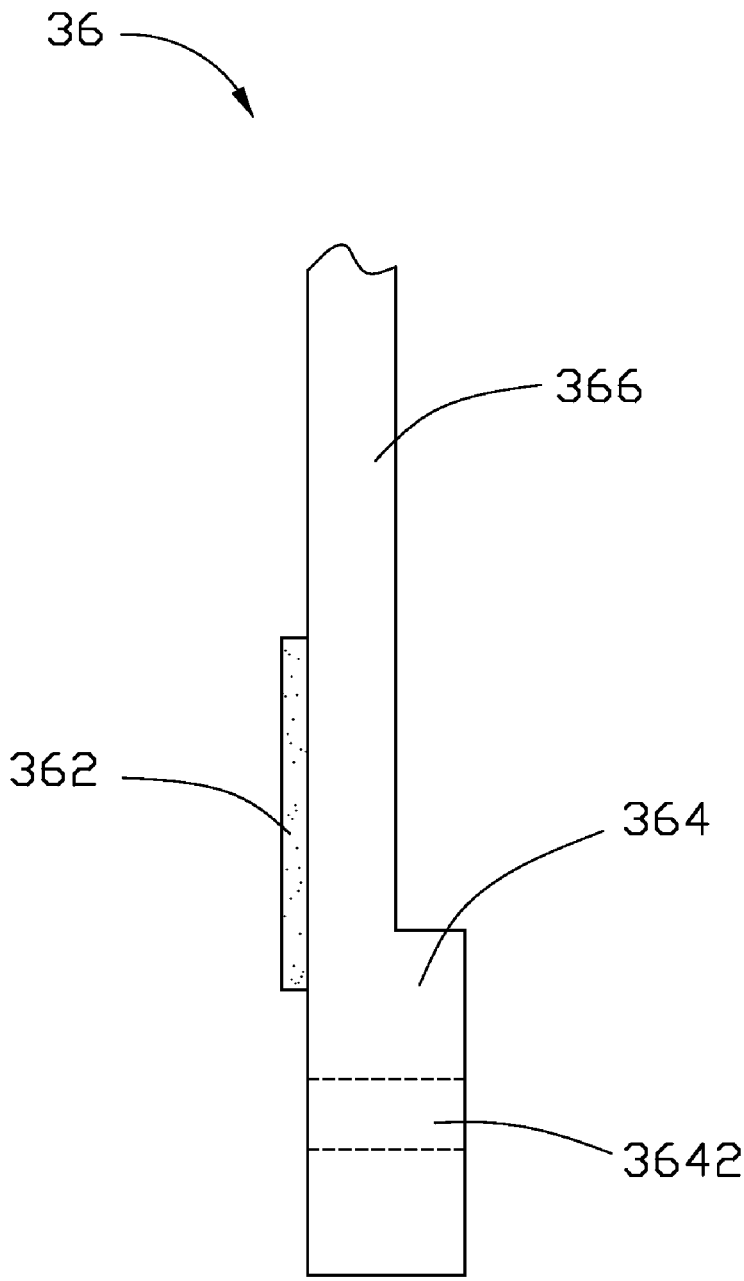
FIG. 4 is a partial top plan view of one swing member of the piezoelectric fan assembly of FIG. 2.
Figure 5:
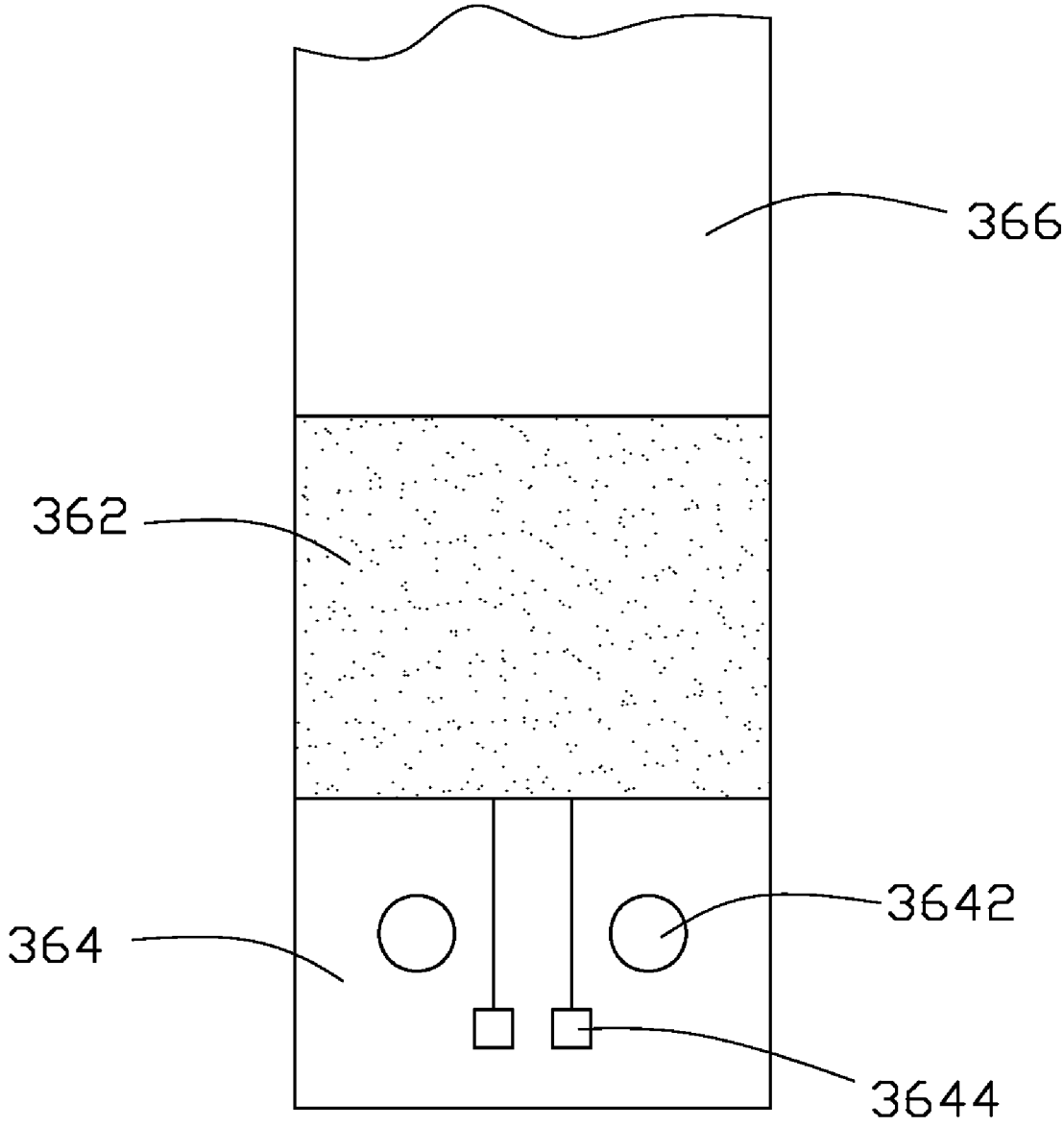
FIG. 5 is a left side elevational view of the swing member of FIG. 4.
Figure 6:
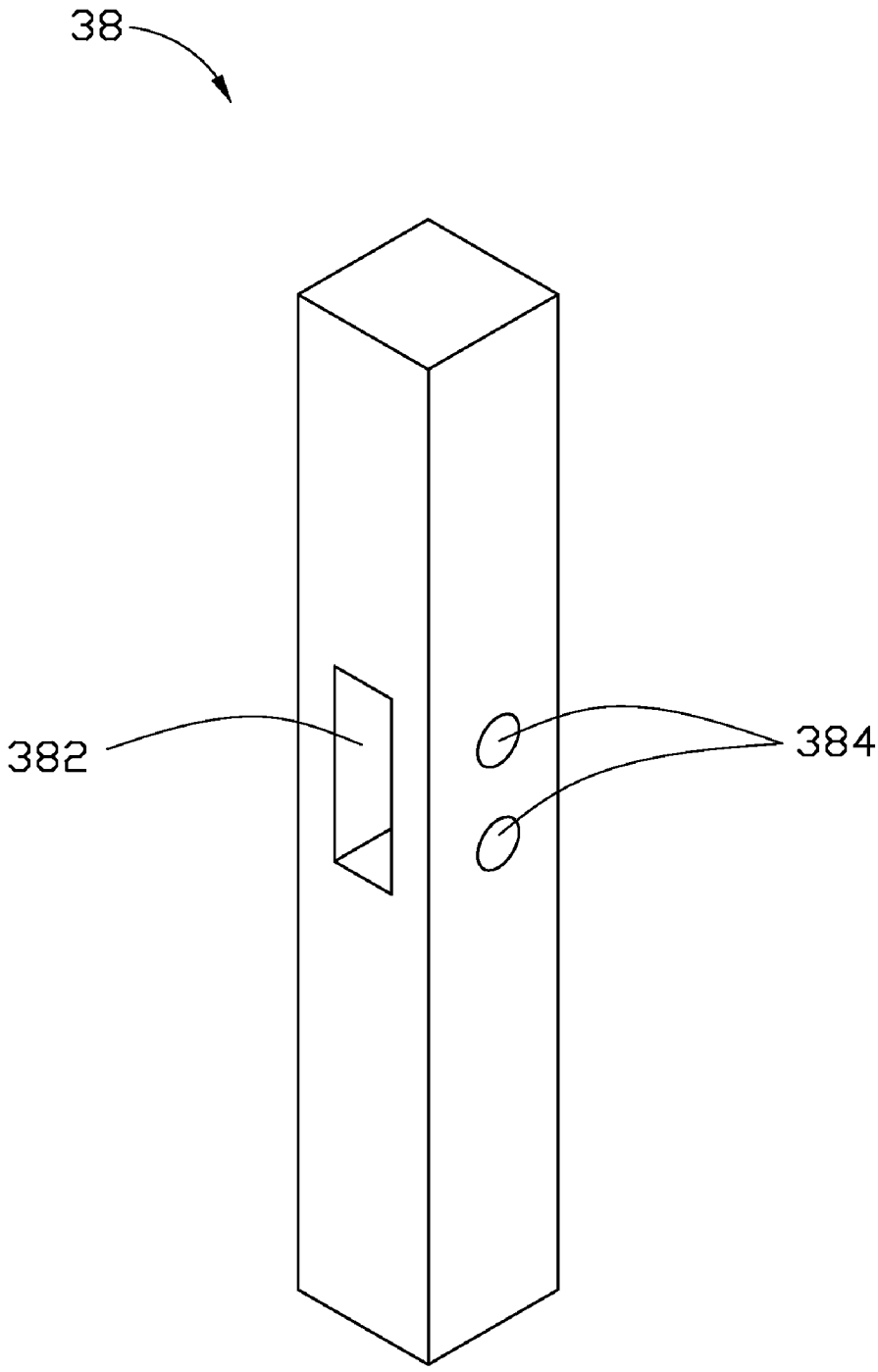
FIG. 6 is an isometric, schematic view of the mandrel of the piezoelectric fan assembly of FIG. 2.
Figure 7:
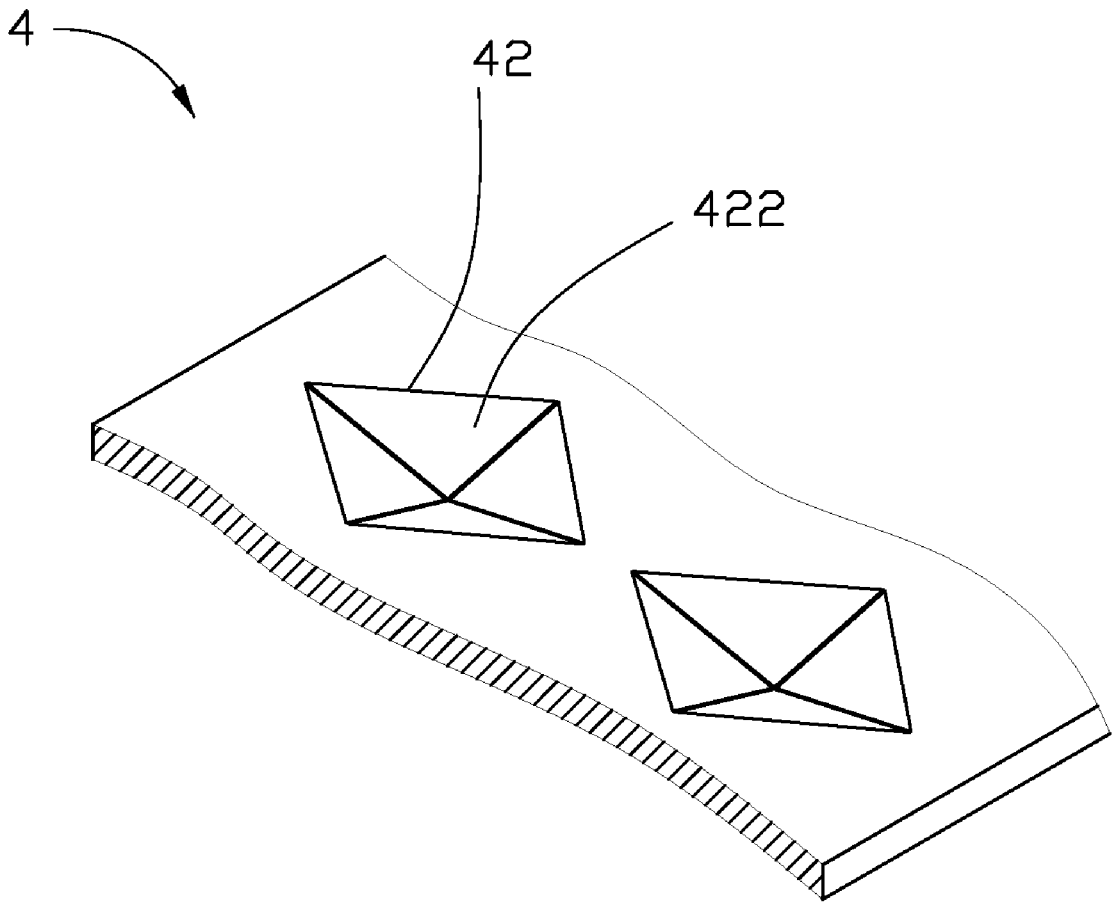
FIG. 7 is a partial, isometric, schematic view of the guide plate of the piezoelectric fan assembly of FIG. 2.
Figure 8:
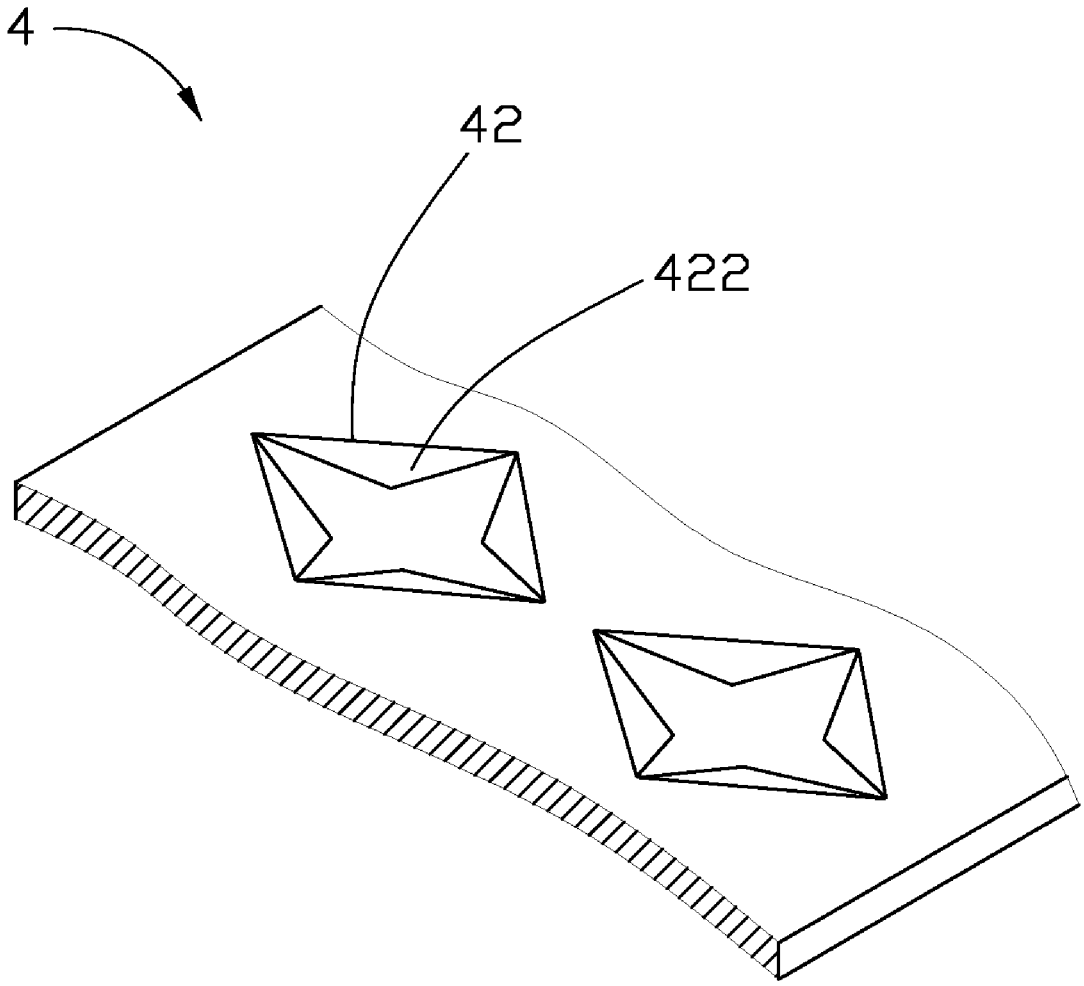
FIG. 8 is similar to FIG. 3, but showing another status of the guide plate.

Referring to FIGS. 4 to 6, each of the swing members 36 includes a piezoelectric element 362, a mounting portion 364, and a swing portion 366. The piezoelectric element 362 is made of piezoelectric ceramic material and mounted on a side of the swing portion 366. The mounting portion 364 is formed on a first end of the swing portion 366. Two through holes 3642 are defined in the mounting portion 364, and two electrodes 3644 are mounted on the mounting portion 364, between the through holes 3642. The swing members 36 can be inserted into two opposite slots 382 defined in the mandrel 38. Two screws pass through two screw holes 384 defined in the mandrel 38 to be engaged in the two through holes 3642 of the mounting portion 364, to fix the mounting portion 364 of each swing member 36 to the mandrel 38. The two electrodes 3644 are connected to an external alternating current (AC) power source (not shown) via leads (not shown) to receive AC power and supply the AC power to the piezoelectric element 362. In one embodiment, each of the swing portions 366 is made of polyester material or other lightweight material. A second end of each of the swing portions 366 is connected to the connecting portion 34. In other embodiments, the fan 3 can includes more than two swing members 36 mounted to the mandrel 38.

Referring to FIGS. 2, 3, 7, and 8, the guide plate 4 is circular and coaxial with the connecting portion 34. The guide plate 4 is mounted on the lower cover 26 and encircles the fan 3. A wind channel 44 is formed between the case 2 and the guide plate 4. A plurality of openings 42 is defined in the guide plate 4 corresponding to the plurality of fan blades 32. In one embodiment, each of the openings 42 is rectangle-shaped. Four triangular unidirectional limiting tabs 422 slantingly extend from four walls bounding each opening 42 towards the wind channel 44, and the limiting tabs 422 are made of lightweight material, such as polyvinylchloride (PVC). The limiting tabs 422 are rotatable relative to the walls bounding a corresponding opening 42. When the fan 3 does not operate, the limiting tabs 422 of each opening 42 are inclined to move towards the opening 42 to cover the opening 42, therefore airflow from the wind channel 44 cannot enter into the guide plate 4 through the opening 42. When the fan 3 operates, the airflow from the fan 3 drives the limiting tabs 422 to rotate to uncover the opening 42, therefore the airflow is transferred to the wind channel 44 through the opening 42. In one embodiment, a width of the wind channel 44 gradually enlarges from a position opposite to the air outlet 22 towards the air outlet 22.

In use, when the two electrodes 3644 of each swing member 36 are connected to the external AC power source, the piezoelectric elements 362 are activated to deform, to drive the two swing members 36 to swing synchronously. Therefore, the connecting portion 34 is driven to rotate back and forth via the swing members 36, and the plurality of fan blades 32 swing together with the connecting portion 34. Therefore, airflow generated by the plurality of fan blades 32 is transferred to the wind channel 44 through the plurality of openings 42, and then is exhausted through the air outlet 22.

Figure 9:
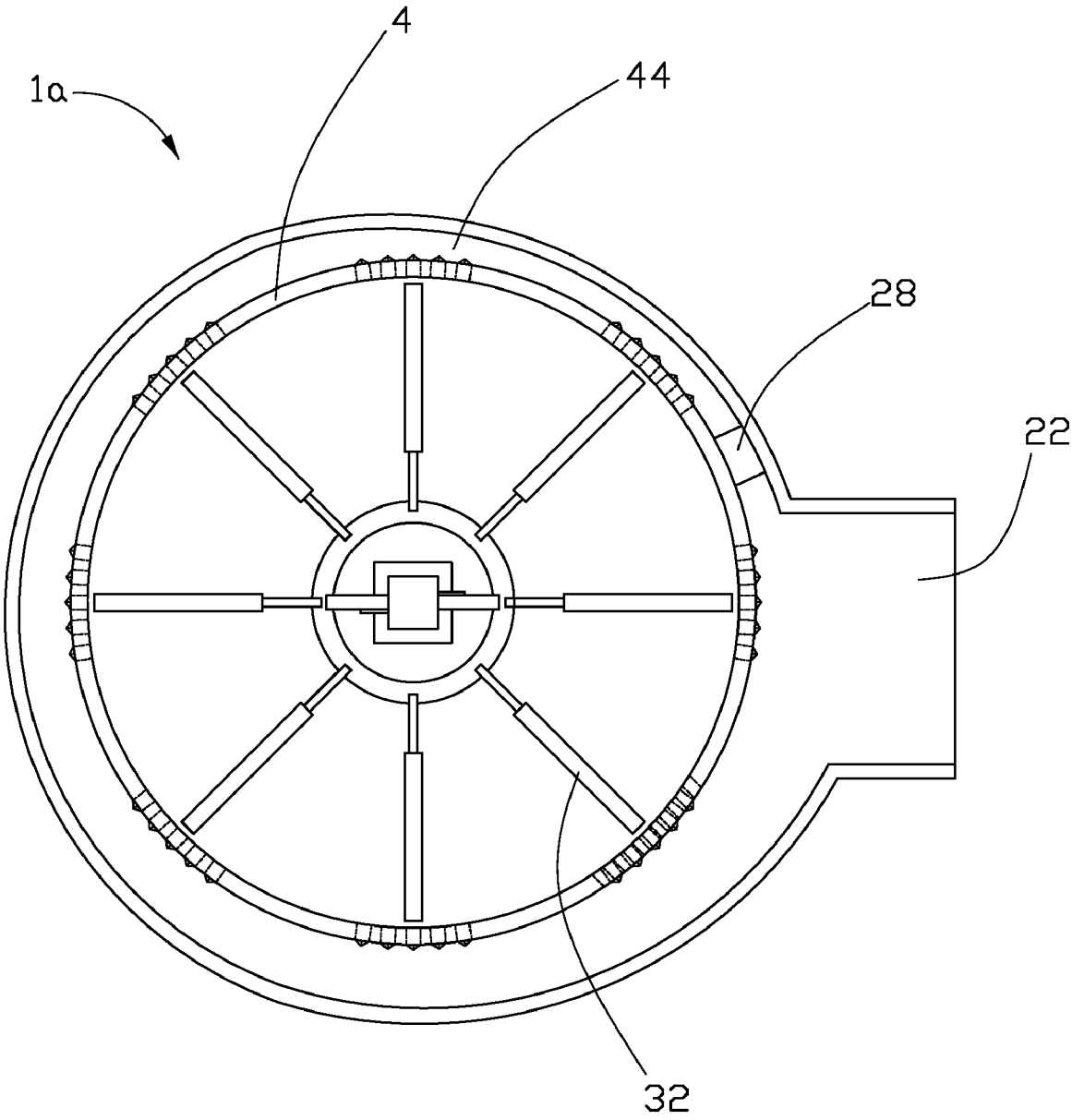
FIG. 9 is top plan view of another exemplary embodiment of a piezoelectric fan assembly, without an upper cover of the piezoelectric fan assembly.

Referring to FIG. 9, another exemplary embodiment of a piezoelectric fan assembly 1*a* is shown, which is similar to the abovementioned embodiment, except that a block 28 is mounted on the lower cover 26, in the wind channel 44 adjacent to the air outlet 22. The block 28 is to prevent airflow in the wind channel 44 from flowing clockwise, and a width of the wind channel 44 at the air outlet 22 is the greatest, while at the block 28 is the smallest.

The piezoelectric fan assembly 1 of this disclosure can generate a concentrated airflow because of the wind channel 44 and the air outlet 22, which provides a good heat dissipating effect.

It is to be understood, however, that even though numerous characteristics and advantages of the present disclosure have been set forth in the foregoing description, together with details of the structure and function of the disclosure, the disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. A piezoelectric fan assembly comprising:
a case defining an air outlet;
a fan arranged in the case, comprising:
a mandrel positioned in the case;
at least one swing member mounted to the mandrel with a first end of each of the at least one swing member, wherein each of the at least one swing member comprises a piezoelectric element;
a circular connecting portion encircling the mandrel and connected to a second end of each of the at least one swing member; and
a plurality of fan blades mounted to the connecting portion, wherein the plurality of fan blades are operable to generate airflow in response to the piezoelectric element receiving alternating current power to swing to drive the connecting portion to swing; and
a guide plate mounted in the case and encircling the fan, wherein a wind channel is formed between the case and the guide plate, a plurality of openings are defined in the guide plate corresponding to the plurality of fan blades, wherein airflow formed by the swinging of the plurality of fan blades is transferred into the wind channel through the plurality of openings and is exhausted out of the wind channel through the air outlet.

2. The piezoelectric fan assembly of claim 1, wherein a plurality of unidirectional limiting tabs extends from walls bounding each of the plurality of openings to guide the airflow from the plurality of fan blades into the wind channel.

3. The piezoelectric fan assembly of claim 2, wherein each of the plurality of openings is rectangle-shaped, the number of the plurality of unidirectional limiting tabs for each opening is four, and a shape of each of the plurality of unidirectional limiting tabs is triangular, the plurality of unidirectional limiting tabs slantingly extend from four walls bounding each of the plurality of openings towards the wind channel.

4. The piezoelectric fan assembly of claim 1, wherein the guide plate is circular and coaxial with the connecting portion.

5. The piezoelectric fan assembly of claim 4, wherein a width of the wind channel from a position opposite to the air outlet towards the air outlet is gradually enlarged.

6. The piezoelectric fan assembly of claim 4, further comprising a block mounted in the case and arranged in the wind channel, adjacent to the air outlet.

7. The piezoelectric fan assembly of claim 6, wherein a width of the wind channel at the air outlet is the greatest, while at the block is the smallest.

8. The piezoelectric fan assembly of claim 1, wherein the plurality of fan blades radially extend out from the connecting portion.

9. The piezoelectric fan assembly of claim 1, wherein the at least one swing member comprises two swing members.

10. The piezoelectric fan assembly of claim 1, wherein the case comprises a lower cover and an upper cover covered on the lower cover.

11. The piezoelectric fan assembly of claim 10, wherein the upper cover and the lower cover are approximately round-shape and connected together to form the air outlet at a circumference of the case.

12. The piezoelectric fan assembly of claim 10, wherein a mounting portion is formed at a position off a center of the lower cover, the mandrel is positioned on the mounting portion.

13. A piezoelectric fan assembly comprising:
a case defining an air outlet;
a fan arranged in the case, comprising
a mandrel positioned in the case;
at least one swing member mounted to the mandrel with a first end of each of the at least one swing member, wherein each of the at least one swing member comprises a piezoelectric element;
a circular connecting portion encircling the mandrel and connected to a second end of each of the at least one swing member; and
a plurality of fan blades mounted to the connecting portion, wherein the plurality of fan blades are operable to generate airflow in response to the piezoelectric element receiving alternating current power to swing to drive the connecting portion to swing; and
a guide plate mounted in the case and encircling the fan, wherein a wind channel is formed between the case and the guide plate, a plurality of openings are defined in the guide plate corresponding to the plurality of fan blades, wherein airflow formed by the swinging of the plurality of fan blades is transferred into the wind channel through the plurality of openings and is exhausted out of the wind channel through the air outlet;
wherein a plurality of unidirectional limiting tabs extends from walls bounding each of the plurality of openings to guide the airflow from the plurality of fan blades into the wind channel, each of the plurality of openings is rectangle-shaped, the number of the plurality of unidirectional limiting tabs for each opening is four, and a shape of each of the plurality of unidirectional limiting tabs is triangular, the plurality of unidirectional limiting tabs slantingly extend from four walls bounding each of the plurality of openings towards the wind channel.

* * * * *